US006698350B2

(12) United States Patent
Iwamloto

(10) Patent No.: US 6,698,350 B2
(45) Date of Patent: Mar. 2, 2004

(54) SHEET PERFECTING APPARATUS FOR SATELLITE-TYPE PRINTING PRESS

(75) Inventor: Masayuki Iwamloto, Shizuoka (JP)

(73) Assignee: Shinohara Machinery Co., Ltd., Shizuoka-Ken (JP)

( * ) Notice: Subject to any disclaimer, the term of this patent is extended or adjusted under 35 U.S.C. 154(b) by 77 days.

(21) Appl. No.: 10/184,793

(22) Filed: Jun. 28, 2002

(65) Prior Publication Data

US 2004/0000749 A1 Jan. 1, 2004

(51) Int. Cl.[7] ..... B41M 1/14

(52) U.S. Cl. ..... 101/211; 101/137; 101/175; 101/229; 101/230

(58) Field of Search ..... 101/211, 483, 101/135, 137, 171, 175, 177, 179, 182, 183, 216, 220, 230

(56) References Cited

U.S. PATENT DOCUMENTS

| | | | | | |
|---|---|---|---|---|---|
| 4,231,291 | A | * | 11/1980 | Davidson, Jr. | 101/137 |
| 4,603,631 | A | * | 8/1986 | Simeth | 101/229 |
| 4,633,777 | A | * | 1/1987 | Germann | 101/177 |
| 4,967,660 | A | * | 11/1990 | Yamanari et al. | 101/229 |
| 5,479,856 | A | * | 1/1996 | Wirz | 101/177 |
| 5,526,107 | A | * | 6/1996 | Bronstein | 101/211 |
| 5,568,245 | A | * | 10/1996 | Ferber et al. | 101/223 |
| 6,220,156 | B1 | * | 4/2001 | Rohloff | 101/177 |
| 6,557,464 | B2 | * | 5/2003 | Käser et al. | 101/143 |
| 2001/0054364 | A1 | * | 12/2001 | Kusaka | 101/483 |
| 2002/0134262 | A1 | * | 9/2002 | Kaser et al. | 101/219 |
| 2003/0172819 | A1 | * | 9/2003 | Hesterman | 101/171 |

FOREIGN PATENT DOCUMENTS

| | | |
|---|---|---|
| JP | 62169645 | 7/1987 |
| JP | 8244195 | 9/1996 |

* cited by examiner

*Primary Examiner*—Eugene H. Eickholt
(74) *Attorney, Agent, or Firm*—Ladas & Parry

(57) ABSTRACT

Sheet perfecting apparatus for a satellite-type printing press by which double-side printing is performed with a single satellite-type press and if sheet perfecting is not needed the sheet is printed on one side only. In the course of printing with a plurality of printing units (26) which are provided in satellite-like manner around a common pressure cylinder (10), a plurality of chain gripper conveyors (38, 42) are arranged in parallel and are connected via a perfecting cylinder (40) to invert the sheet of material.

23 Claims, 8 Drawing Sheets

SHEET PERFECTING APPARATUS FOR SATELLITE-TYPE PRINTING PRESS

BACKGROUND OF THE INVENTION

1. Field of the Invention

The present invention relates generally to satellite-type printing press for sheet-fed printing, or more precisely, to sheet perfecting apparatus for such printing press.

2. Description of the Prior Art

Satellite-type printing press is known in which many printing units (four color units, for example) are provided in satellite-like manner around common pressure cylinder of large diameter. Such satellite-type printing press is a new step toward corresponding to the need of multi-sort short run printing.

In Japanese unexamined patent laid-open 244195/1996, a technique is disclosed in which a plurality of satellite-type printing presses are connected via sheet perfecting apparatus. According to the technique, four color printing is done on the surface of sheet by first satellite-type press and, after reversing the sheet, also four color printing is put on the opposite side of the sheet by the second satellite-type press.

From Japanese unexamined patent laid-open 169645/1987, for example, a technique is well known in which many printing units are connected in series and sheet perfecting apparatus is interposed therein.

It is true that both sides of sheet can be printed at one pass by the satellite-type printing press shown in before-mentioned Japanese unexamined patent laid-open 244195/1996, but the equipment is huge and switching of printing format is not at all flexible, as the technique presupposes two satellite-type printing units.

Also, before-mentioned sheet perfecting apparatus of series type printing press has a tendency to cause register error through gripping change of sheet, as the perfecting apparatus stays the sheet transfer path during one-side printing in which sheet perfecting is not needed.

SUMMARY OF THE INVENTION

In view of the above-described problems of the prior art techniques, the present invention provides an improved sheet perfecting apparatus for satellite-type printing press and aims at enabling double-side printing by only one satellite-type printing press itself, and preventing register error without connecting with sheet transfer path in case sheet reversing is not needed.

In accordance with sheet perfecting apparatus of the present invention, in the course of many printing units which are provided in satellite-like manner around a common pressure cylinder, a plurality of chain gripper means are paralleled and these means are connected via a perfecting cylinder.

The first chain gripper means accept the front end of sheet from common pressure cylinder and the sheet is then turned toward distant direction of common pressure cylinder. In the course of such sheet transfer, the rear end of sheet is gripped by perfecting gripper of perfecting cylinder and the sheet is reversed in accordance with the rotation of the cylinder. Then, the sheet is approached and transferred from the second chain gripper means to common pressure cylinder.

These and other objects of the invention will become apparent from the following description with reference to the drawings. But, these show merely an embodiment of the present invention.

DESCRIPTION OF PREFERRED EMBODIMENT

Figure 1:
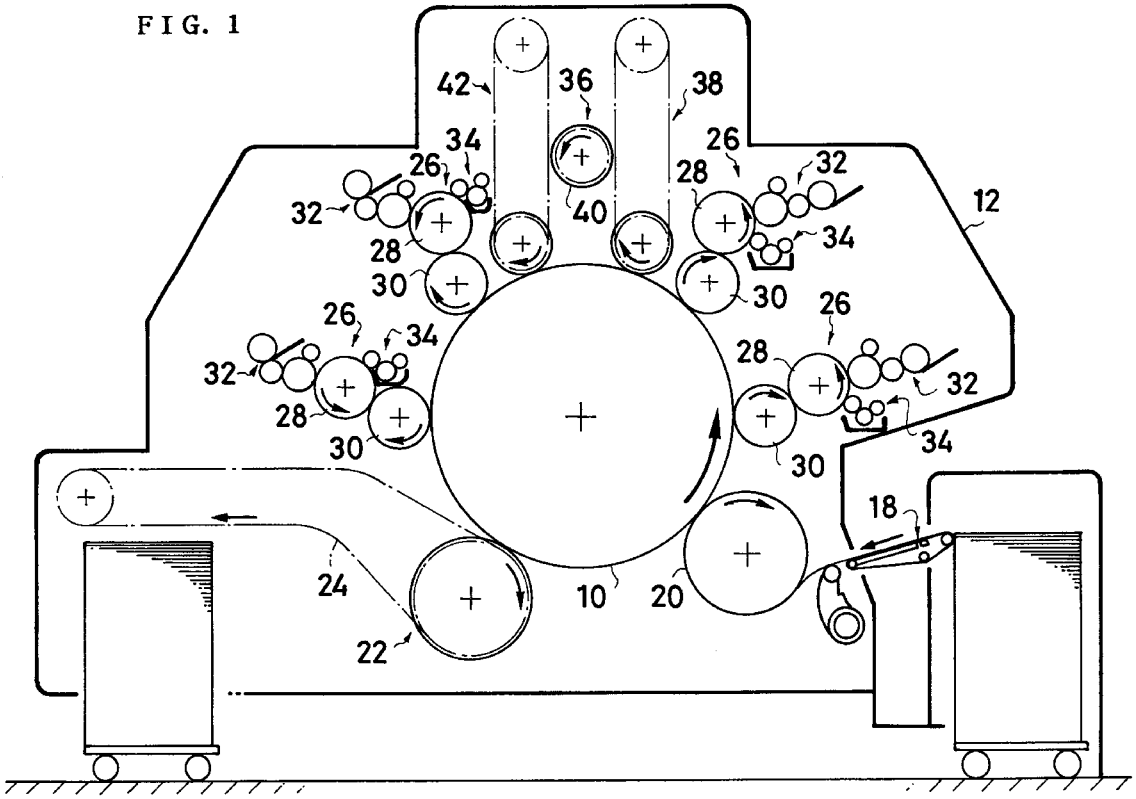
FIG. 1 is a schematic view showing an embodiment of sheet perfecting apparatus for satellite-type printing press according to the present invention.

In the center of FIG. 1, common pressure cylinder 10 of relatively large diameter is shown which is rotatably supported between a pair of side frames 12 of printing press and is driven by motor (not shown).

The common pressure cylinder 10 has grippers 16 which grip the end of sheet. The common pressure cylinder 10 is a base for accepting sheet 14 from feeding cylinder 20 of sheet feeder 18 in the upper stream and, after printing, for delivering the printed sheet to delivery chain 24 of sheet delivery device 22 in the lower stream.

Four sets of printing units 26 are provided in satellite-like manner around the common pressure cylinder 10. In order to perform offset printing, these printing units 26 have plate cylinder 28 equipped with printing plate and blanket cylinder 30 to transfer images. In addition, the plate cylinder 28 has inking device 32 and damping system 34. The diameter of the common pressure cylinder 10 around which printing units 26 are provided in satellite-like manner is integer times (for example, four times) as large as that of plate cylinder 28 in order to perform multi-color printing by these printing units 26 in compliance with the rotation of the common pressure cylinder 10 which is driven by motor (not shown).

Sheet perfecting apparatus 36 according to the present invention is provided between second and third printing units 26, basing upon rotational direction of common pressure cylinder 10 (counterclockwise in FIG. 1). From upper stream to down stream of sheet transfer path, the sheet perfecting apparatus 36 comprises first chain gripper means 38, perfecting cylinder 40 and second chain gripper means 42.

The concrete construction of first chain gripper means 38 can be imagined from delivery chain 24 of sheet delivery device 22. A pair of sprocket wheels 44, 46 are provided near the circumference and upright position of common pressure cylinder 10 and rotatably supported by side frame 12 of printing press. Chain 48 is wound between sprocket wheels 44, 46. (Also, another chain is wound between another pair of sprocket wheels which are provided at intervals perpendicular to the figure.) Grippers 50 are attached at proper intervals to supporting bar (not shown) which is extended between chain 48. Running of chain 48 for first chain gripper means 38 and opening as well as shutting of gripper 50 are timed by drive force from printing press. Position of gripper 50 in longitudinal direction of chain 48 is decided upon that of gripper 16 on common pressure cylinder 10.

Figure 2:
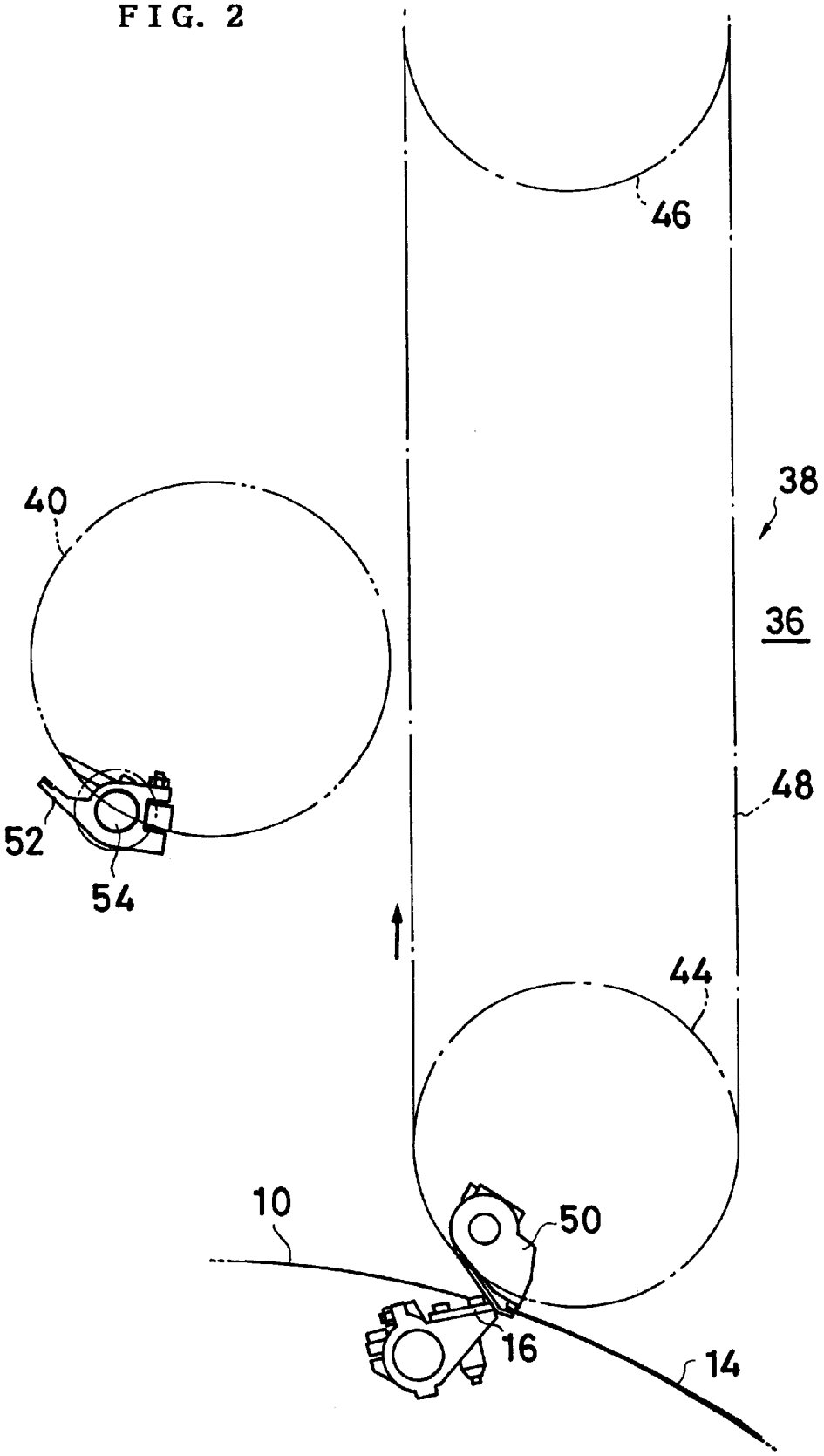
FIG. 2 shows the first chain gripper means and perfecting cylinder of sheet perfecting apparatus.

As shown in FIG. 2, running direction of chain 48 is clockwise in the figure, in other words, the direction that accepts front end of sheet 14 and lead it to remote direction from circumference of common pressure cylinder 10.

Figure 8:
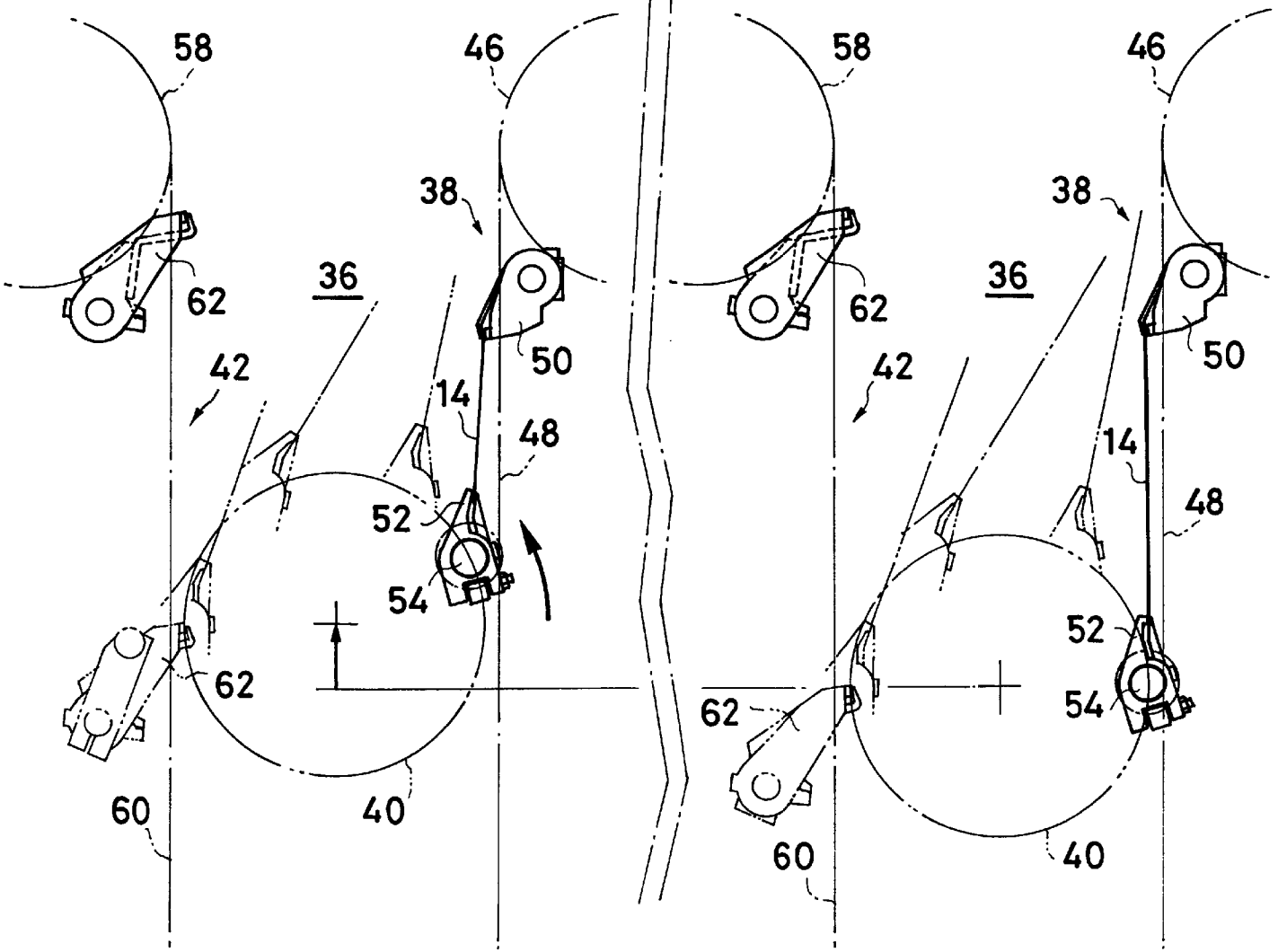
FIG. 8 shows a state in which position of perfecting cylinder is adjusted in accordance with sheet length.

Perfecting cylinder 40 of sheet perfecting apparatus 36 is situated between first and second chain gripper means 38, 42 which run in parallel and perfecting gripper 52 is swingably provided around circumference of cylinders. As to perfecting gripper 52, a pair of fingers are opened as well as closed for gripping sheet 14 end and gripper 52 swings around axis 54 for position control. Such perfecting gripper 52 is well known in the prior art series-type printing press. Perfecting cylinder 40 is rotatably supported between side frames 12 and, as shown in FIG. 8, moved in parallel to first and second chain gripper means 38, 42 far and near from common pressure cylinder 10 in compliance with sheet length (length of sheet 14 in its running direction). In concrete, support portion of perfecting cylinder 40 is groove-fitted with side frame 12 and slidably adjusted in compliance with sheet length. As second chain gripper means 42 accepts drive force from printing press, perfecting cylinder 40 further takes up its rotation force from second chain gripper means 42.

Figure 5:
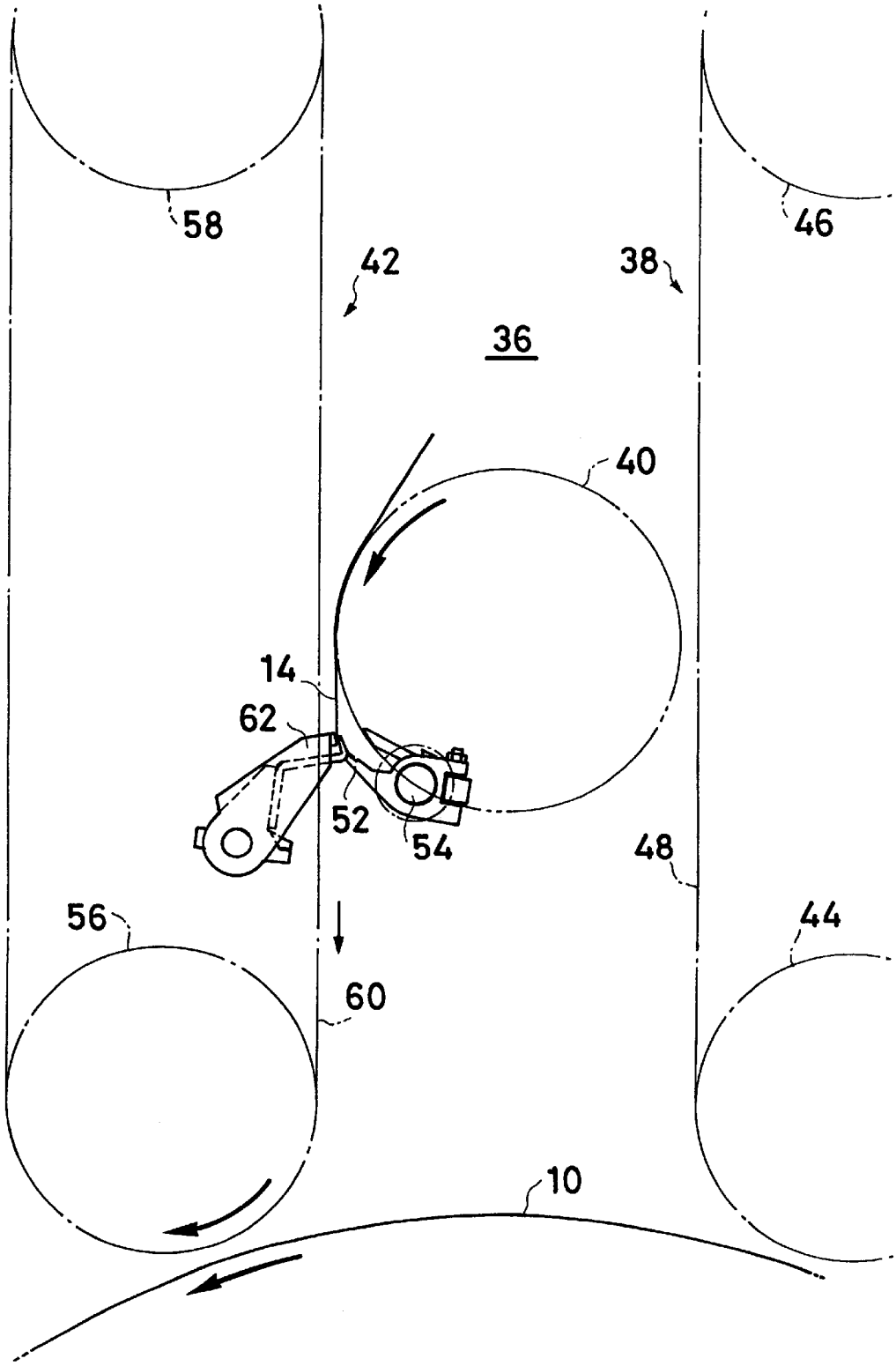
FIG. 5 mainly shows second gripper means of sheet perfecting apparatus.

Construction of second chain gripper means 42 is similar to that of first chain gripper means 38. As shown in FIG. 5, chain 60 is wound between sprocket wheels 56, 58 near the circumference and upright position of common pressure cylinder 10. (Also, another chain is wound between another pair of sprocket wheels which are provided at intervals perpendicular to the figure.) Grippers 62 are attached at proper intervals to supporting bar (not shown) which is extended between chain 60. Running direction of second chain gripper means 42 is also clockwise in the figure. The substantial role is accepting sheet 14 end and transferring it to common pressure cylinder 10.

Figure 7:
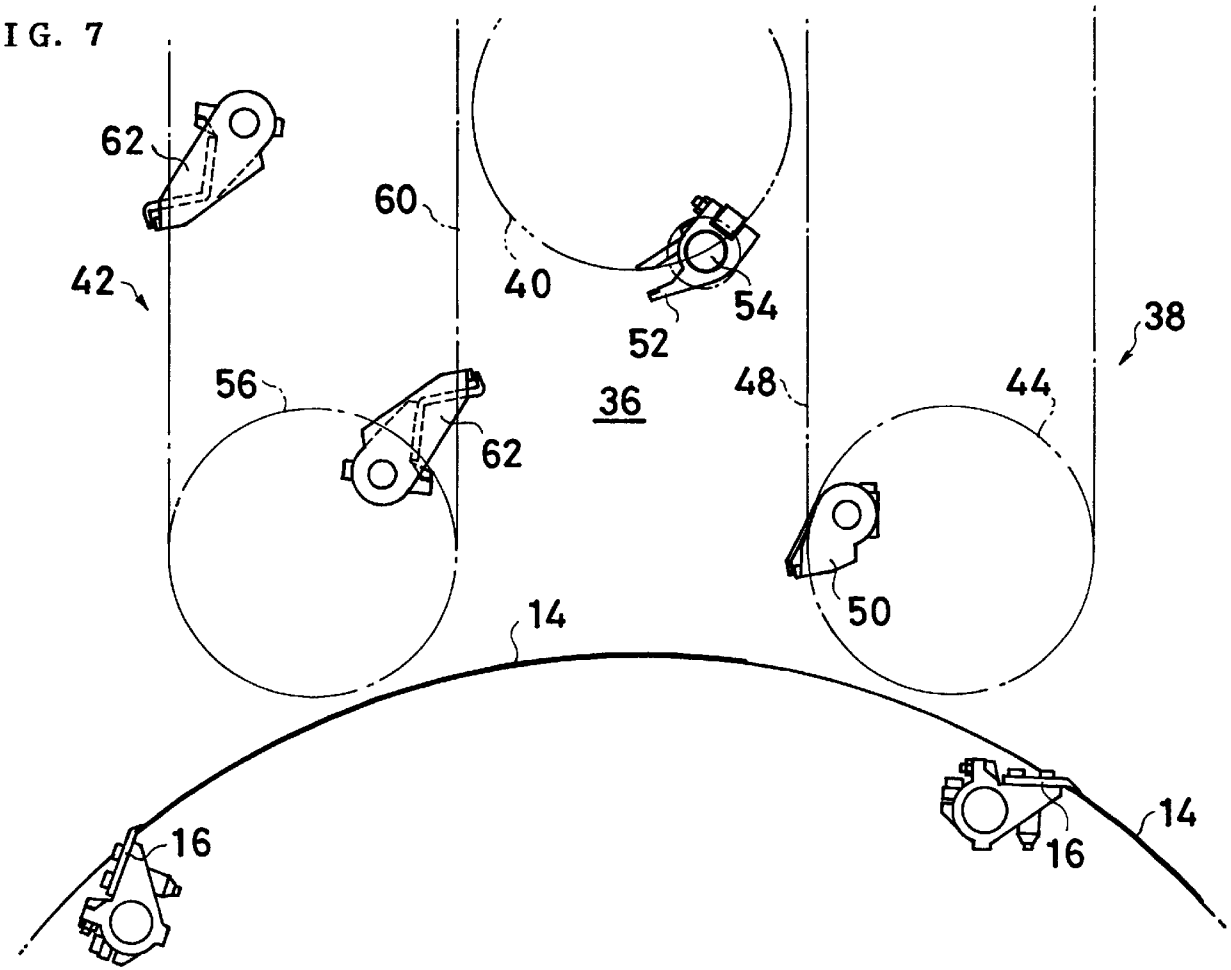
FIG. 7 shows a state in which sheet perfecting apparatus has no connection with sheet transfer path.

In case of one-side printing (surface printing) in which sheet perfecting is not needed, sprocket wheels 44, 56 of first and second chain gripper means 38, 42 are separated from common pressure cylinder 10, as shown in FIG. 7, or else rotation of sprocket wheels 44, 56 are stopped. Thereby, first and second chain gripper means 38, 42 have no connection with sheet 14 which is transferred by gripper 16 of common pressure cylinder 10.

Next, function of above-described construction is detailed. In double-side printing (perfect printing) in which sheet 14 is reversed, two colors are printed on the surface of sheet 14 by first and second printing units 26. Front end of sheet 14 is gripped by gripper 16 of common pressure cylinder 10 and, as shown in FIG. 2, reaches at opposing point of common pressure cylinder 10 against sprocket wheel 44 of first chain gripper means 38. Front end of sheet 14 is then accepted by gripper 50 of first chain gripper means 38 and sheet 14 is transferred away from common pressure cylinder 10 with running of chain 48.

Figure 3:
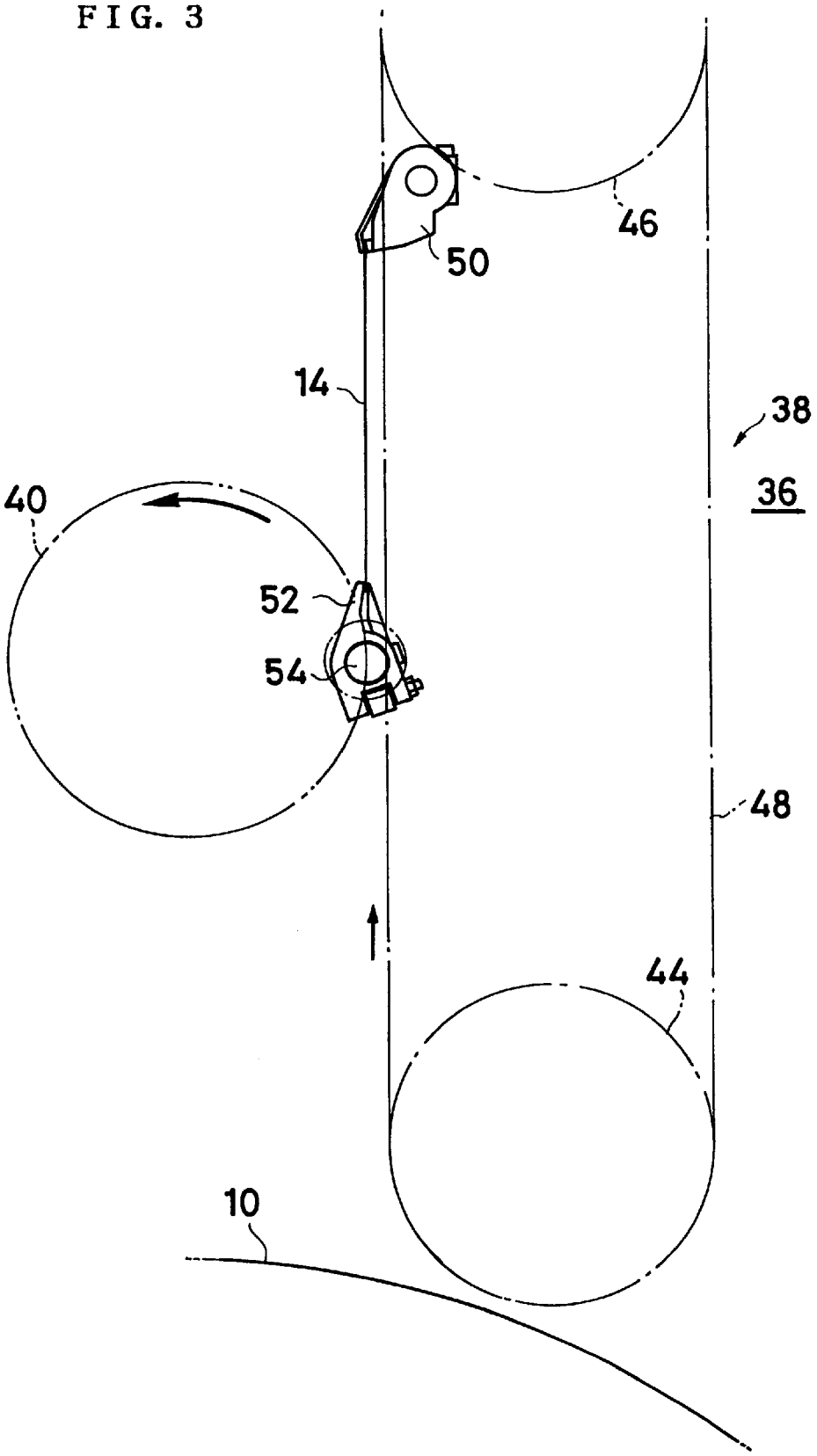
FIG. 3 shows a state in which rear end of sheet is gripped by perfecting gripper of perfecting cylinder.

Sheet 14 is transferred to upright direction along chain 48. When rear end reaches at opposing point against perfecting cylinder 40, as shown in FIG. 3, rear end is gripped by perfecting gripper 52 of perfecting cylinder 40.

Figure 4:
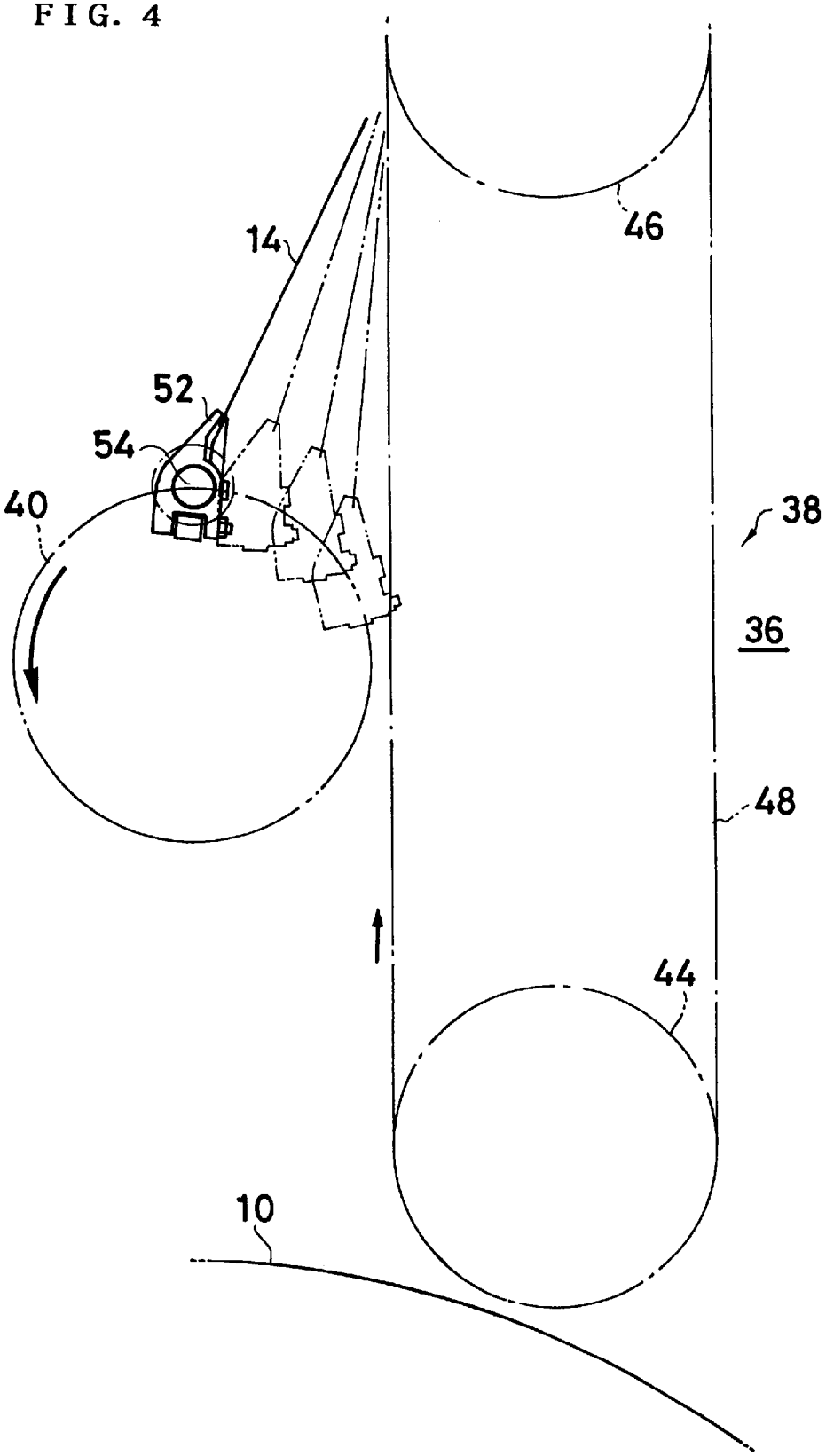
FIG. 4 shows a state in which sheet is reversed in accordance with the rotation of perfecting cylinder.

Then, as shown in FIG. 4, perfecting gripper 52 which gripped rear end of sheet 14 turns in accordance with rotation of perfecting cylinder 40, thereby sheet 14 is reversed.

Figure 6:
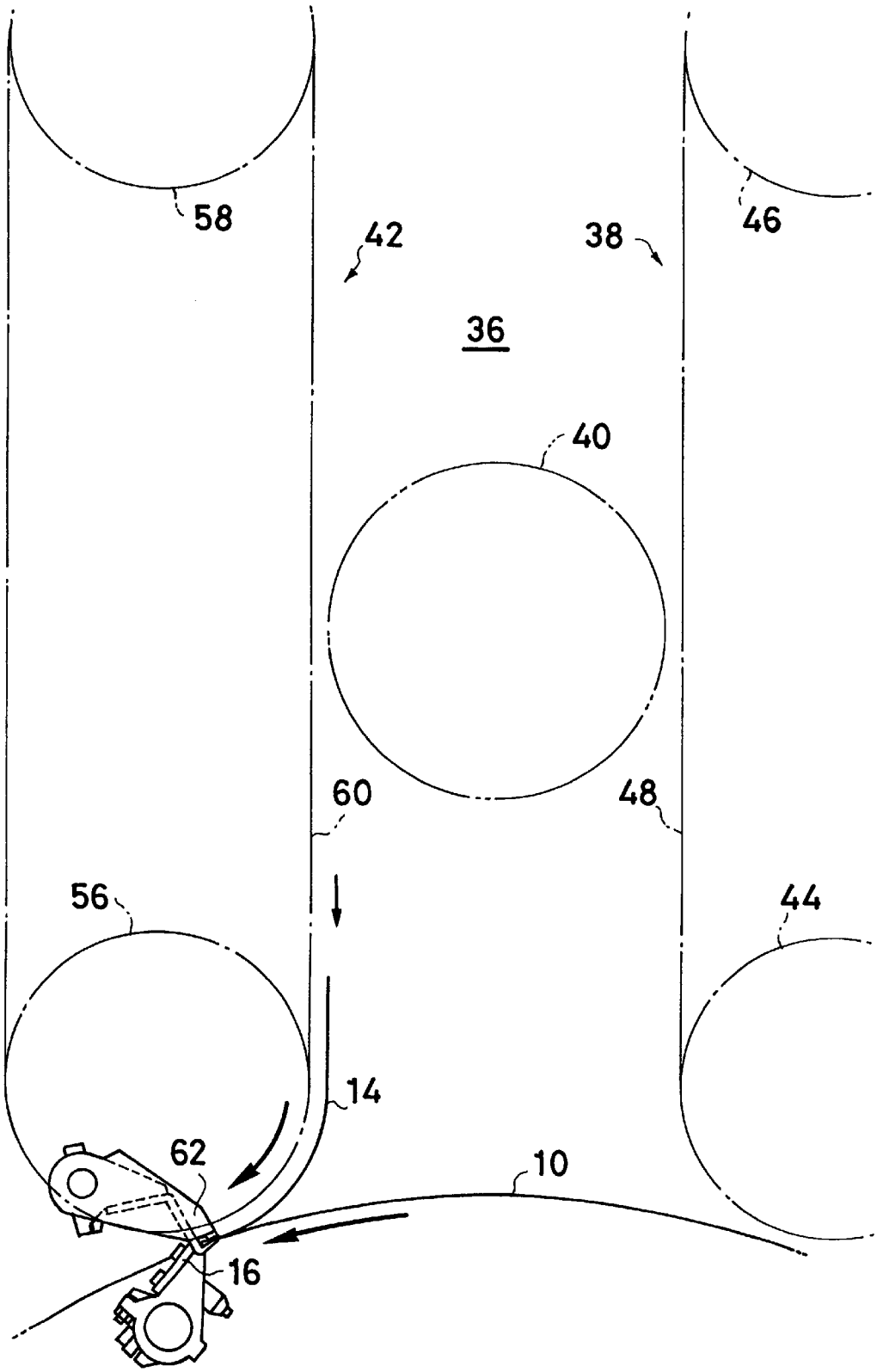
FIG. 6 shows a state in which sheet is returned to common cylinder.

In FIG. 5, sheet 14 end (which was rear end before) is delivered to gripper 62 of second chain gripper means 42 at opposing point of perfecting cylinder 40 against second chain gripper means 42. Substantial role of second chain gripper means 42 is to lead sheet 14 to common pressure cylinder 10 again and, as shown in FIG. 6, sheet 14 end is delivered to common pressure cylinder 10 at opposing point against sprocket wheel 56.

Hereafter, third and fourth printing units 26 print on backside of sheet 14 and finally double-side printing of two colors on surface as well as two colors on backside is completed.

As described before in relation to FIG. 8, position of perfecting cylinder 40 is adjusted in parallel to first and second chain gripper means 38, 42 in compliance with sheet length.

Sheet perfecting apparatus according to the present invention has, as described with FIG. 7, no relation with sheet transfer path in one-side printing in which sheet reversing is not needed.

According to the present invention, double-side printing of, for example, two colors on surface as well as two colors on backside is possible by only one satellite-type printing press, as in the course of many printing units 26 which are provided in satellite-like manner around common pressure cylinder 10, a plurality of chain gripper means 38, 42 are paralleled and these means 38, 42 are connected via perfecting cylinder 40. The apparatus does not intervene in sheet transfer path in one-side printing in which sheet reversing is not needed, therefore, high register accuracy is secured. In addition, despite variety of sheet length, corresponding adjustment can easily be attained by the apparatus.

As detailed, sheet perfecting apparatus is very unique in its construction and can contribute to the progress of printing technique.

The present invention is not limited to the embodiment described hitherto. Various changes and modification can, of course, be made without departing from the spirit of the invention.

DESCRIPTION OF THE REFERENCE NUMERALS

10 common pressure cylinder
14 sheet
16 gripper
26 printing unit
36 sheet perfecting apparatus
38 first chain gripper
40 perfecting cylinder
42 second chain gripper
50 gripper
52 perfecting gripper
62 gripper

What is claimed is:

1. A satellite-type printing press for two side printing of a sheet of material comprising:

a common pressure cylinder on which a sheet of material can be advanced from an upstream supply station to a downstream delivery station, first and second printing means angularly spaced around said common pressure cylinder for effecting color printing on said sheet of material while being advanced on said common pressure cylinder, and sheet perfecting apparatus disposed between said first and second printing means for inverting said sheet of material so that the first printing means prints on one side of said sheet of material and the second printing means prints on an opposite side of said sheet of material, said sheet perfecting apparatus comprising:

first and second spaced conveyor means extending outwardly from said common pressure cylinder, and a perfecting cylinder between said first and second conveyor means, said first conveyor means gripping a front end of said sheet of material and conveying said sheet of material away from said common pressure cylinder, said perfecting cylinder gripping a rear end of said sheet of material and conveying the sheet of material around said perfecting cylinder towards said second conveyor means, said second conveyor means gripping the rear end of the sheet of material and advancing the sheet of material, rear end first, and returning the sheet of material now inverted to the common pressure cylinder for advancement through the second printing means for printing on said opposite side thereof.

2. The satellite-type printing press of claim 1, wherein said first and second conveyor means extend parallel to one another.

3. The satellite-type printing press of claim 2, wherein said perfecting cylinder is adjustable towards and away from said common pressure cylinder in a direction parallel to said first and second conveyor means.

4. The satellite-type printing press of claim 2, wherein said first and second conveyor means extend radially with respect to said common pressure cylinder.

5. The satellite-type printing press of claim 1, wherein said first and second conveyor means each comprises a chain conveyor.

6. The satellite-type printing press of claim 5, wherein said chain conveyors and said perfecting cylinder each comprises releasable grippers for respectively gripping and releasing the sheet of material.

7. The satellite-type printing press of claim 6, wherein the perfecting cylinder and the common pressure cylinder rotate in the same direction, said chain conveyors of said first and second conveyor means having lengths on opposite sides of said common pressure cylinder which travel in opposite directions.

8. The satellite-type printing press of claim 1, wherein said first and second printing means respectively comprise a plurality of printing units for multiple printing on said sheet of material.

9. The satellite-type printing press of claim 1, wherein said first and second conveyor means are releasable from said common pressure cylinder to enable one side printing on said sheet of material.

10. A method of color printing on two sides of a sheet of material by a single satellite-type printing press comprising the steps of:

advancing a sheet of material on a common pressure cylinder from an upstream supply station to a downstream delivery station, printing in one or more colors on a topside surface of the sheet of material, transferring the sheet of material, now printed on its topside surface, to a perfecting cylinder in an inverted condition and transferring the sheet of material, in inverted condition, from the perfecting cylinder back to the common pressure cylinder, and printing in one or more colors on a bottom surface of the now inverted sheet of material, said sheet of material being transferred to and from said perfecting cylinder by two chain conveyors.

11. The method of claim 10, in which the chain conveyors transport the sheet of material along parallel paths on opposite sides of the perfecting cylinder.

12. The method of claim 11, comprising adjusting the perfecting cylinder between the chain conveyors in a direction parallel to said paths in correspondence with length of the sheet of material.

13. The method of claim 12, wherein said paths extend radially with respect to said common pressure cylinder.

14. The method of claim 10, wherein a front end of the sheet of material is gripped by the common pressure cylinder and is conveyed thereon for the printing on the topside surface thereof whereafter the front end of the sheet of material is gripped by one of the chain conveyors and removed from the common pressure cylinder whereafter a rear end of the sheet of material is gripped by the perfecting cylinder and the sheet of material is transferred to the perfecting cylinder in said inverted condition and thereafter released to the other said chain conveyor wherefrom the sheet of material, now inverted, is supplied to the common pressure cylinder for color printing in one or more colors on the other side of the sheet of material.

15. In a satellite-type printing press having a common pressure cylinder on which a sheet of material can be advanced from an upstream supply station to a downstream delivery station for passage between first and second printing means for color printing on the sheet of material, the improvement comprising means for two-side printing on said sheet of material including, sheet perfecting apparatus disposed between said first and second printing means for inverting said sheet of material so that the first printing means prints on one side of said sheet of material and the second printing means prints on an opposite side of said sheet of material, said sheet perfecting apparatus comprising:

first and second spaced conveyor means extending outwardly from said common pressure cylinder, and a perfecting cylinder between said first and second conveyor means, said first conveyor means gripping a front end of said sheet of material and conveying said sheet of material away from said common pressure cylinder, said perfecting cylinder gripping a rear end of said sheet of material and conveying the sheet of material around said perfecting cylinder towards said second conveyor means, said second conveyor means gripping the rear end of the sheet of material and advancing the sheet of material, rear end first, and returning the sheet of material, now inverted, to the common pressure cylinder for advancement through the second printing means for printing on said opposite side thereof.

16. The apparatus of claim 15, wherein said first and second conveyor means extend parallel to one another.

17. The apparatus of claim 16, wherein said perfecting cylinder is adjustable towards and away from said common pressure cylinder in a direction parallel to said first and second conveyor means.

18. The apparatus of claim 16, wherein said first and second conveyor means extend radially with respect to said common pressure cylinder.

19. The apparatus of claim 16, wherein said first and second conveyor means each comprises a chain conveyor.

20. The apparatus of claim 19, wherein said chain conveyor and said perfecting cylinder each comprises releasable grippers for respectively gripping and releasing the sheet of material.

21. The apparatus of claim 20, wherein the perfecting cylinder and the common pressure cylinder rotate in the same direction, said chain conveyors of said first and second conveyor means having lengths on opposite sides of said common pressure cylinder which travel in opposite directions.

22. The apparatus of claim 15, wherein said first and second printing means respectively comprise a plurality of printing units for multiple printing on said sheet of material.

23. The apparatus of claim 15, wherein said first and second conveyor means are releasable from said common pressure cylinder to enable one side printing on said sheet of material.

* * * * *

UNITED STATES PATENT AND TRADEMARK OFFICE

CERTIFICATE OF CORRECTION

PATENT NO. : 6,698,350 B2
DATED : March 2, 2004
INVENTOR(S) : Masayuki Iwamoto

It is certified that error appears in the above-identified patent and that said Letters Patent is hereby corrected as shown below:

Title page,
Item [75], "Iwamloto" should read -- Iwamoto --.

Signed and Sealed this

Twenty-fifth Day of May, 2004

JON W. DUDAS
*Acting Director of the United States Patent and Trademark Office*